United States Patent [19]

Tragesser

[11] 4,434,334

[45] Feb. 28, 1984

[54] CIRCUIT INTERRUPTER

[75] Inventor: Charles W. Tragesser, Murrysville, Pa.

[73] Assignee: Westinghouse Electric Corp., Pittsburgh, Pa.

[21] Appl. No.: 193,067

[22] Filed: Oct. 2, 1980

[51] Int. Cl.[3] ..... H01H 33/70

[52] U.S. Cl. ..... 200/148 R; 200/148 A

[58] Field of Search ..... 200/148 A, 148 D, 148 R, 200/148 G

[56] References Cited

U.S. PATENT DOCUMENTS

| | | | |
|---|---|---|---|
| 3,164,703 | 1/1965 | Friedrich et al. | 200/148 A |
| 3,218,420 | 11/1965 | Forwald | 200/148 A |
| 4,103,130 | 7/1978 | Leeds | 200/148 A |
| 4,144,426 | 3/1979 | Kowalik et al. | 200/148 A |
| 4,223,191 | 9/1980 | Calvino | 200/148 A |

FOREIGN PATENT DOCUMENTS

| | | | |
|---|---|---|---|
| 670679 | 10/1964 | Italy | 200/148 A |

*Primary Examiner*—Robert S. Macon

*Attorney, Agent, or Firm*—Benjamin Hudson, Jr.

[57] ABSTRACT

This invention provides a new circuit interrupter construction utilizing a means of mounting the interrupter units on the roof of the control housing that supports the drive mechanism and other control apparatus.

6 Claims, 6 Drawing Figures

CIRCUIT INTERRUPTER

BACKGROUND OF THE INVENTION

1. Field of the Invention:

This invention relates generally to puffer type compressed gas circuit interrupters, and more particularly to subtransmission type circuit interrupters for use in the voltage rating of 34.5 kV to 72.5 kV.

2. Description of the Prior Art:

Application of circuit interrupters in the subtransmission voltage classifications has been dominated by the low cost oil circuit breaker. Even with the flammable properties of oil and the high degree of maintenance associated with the oil circuit breaker, the high cost of $SF_6$ puffer type breakers have not allowed power engineers to benefit from the advantages of $SF_6$ technology. An $SF_6$ puffer type circuit interrupter has been needed in the subtransmission voltage classifications that allows power engineers the opportunity to take advantage of the new $SF_6$ technology at a cost competitive with oil circuit breakers.

BRIEF SUMMARY OF THE INVENTION

This invention provides a new puffer type $SF_6$ circuit breaker that incorporates unique design features with an economical low cost construction. This new puffer is designed to rest on the roof of the control housing that contains the mechanical operator and other control apparatus. This arrangement allows the drive mechanism to operate as close to the active components as possible to maintain closer mechanical tolerances for faster reliable action.

DESCRIPTION OF THE PREFERRED EMBODIMENTS

Figure 2:
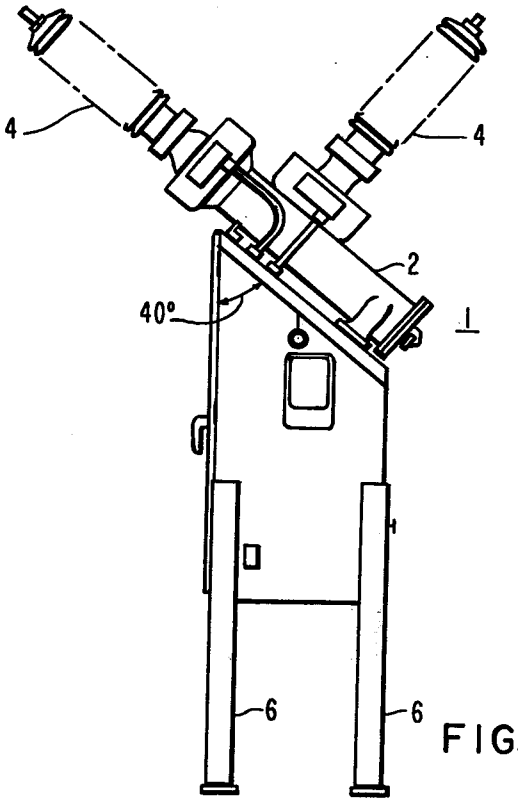
FIG. 2 is an end view of the circuit interrupter shown in FIG. 1.
Figure 1:
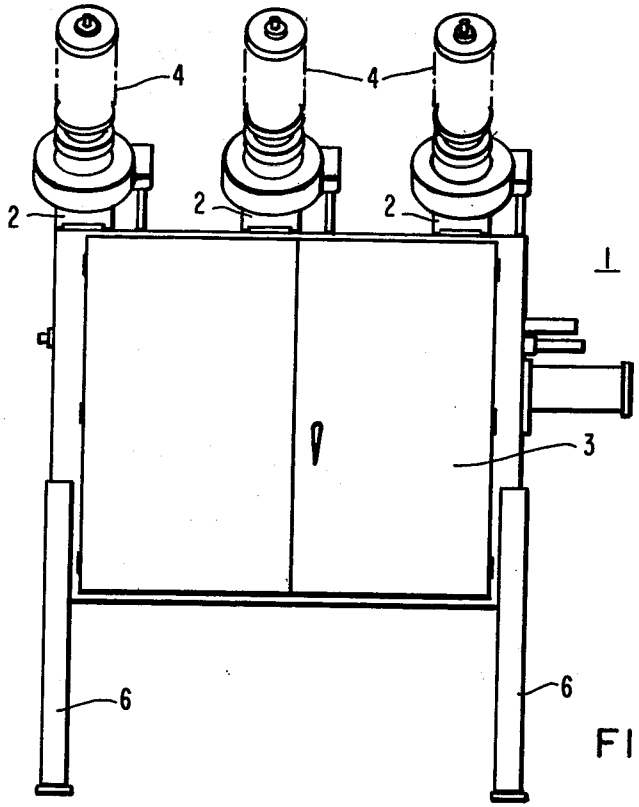
FIG. 1 is a front view of the circuit interrupter incorporating the principles of this invention.
Figure 4:
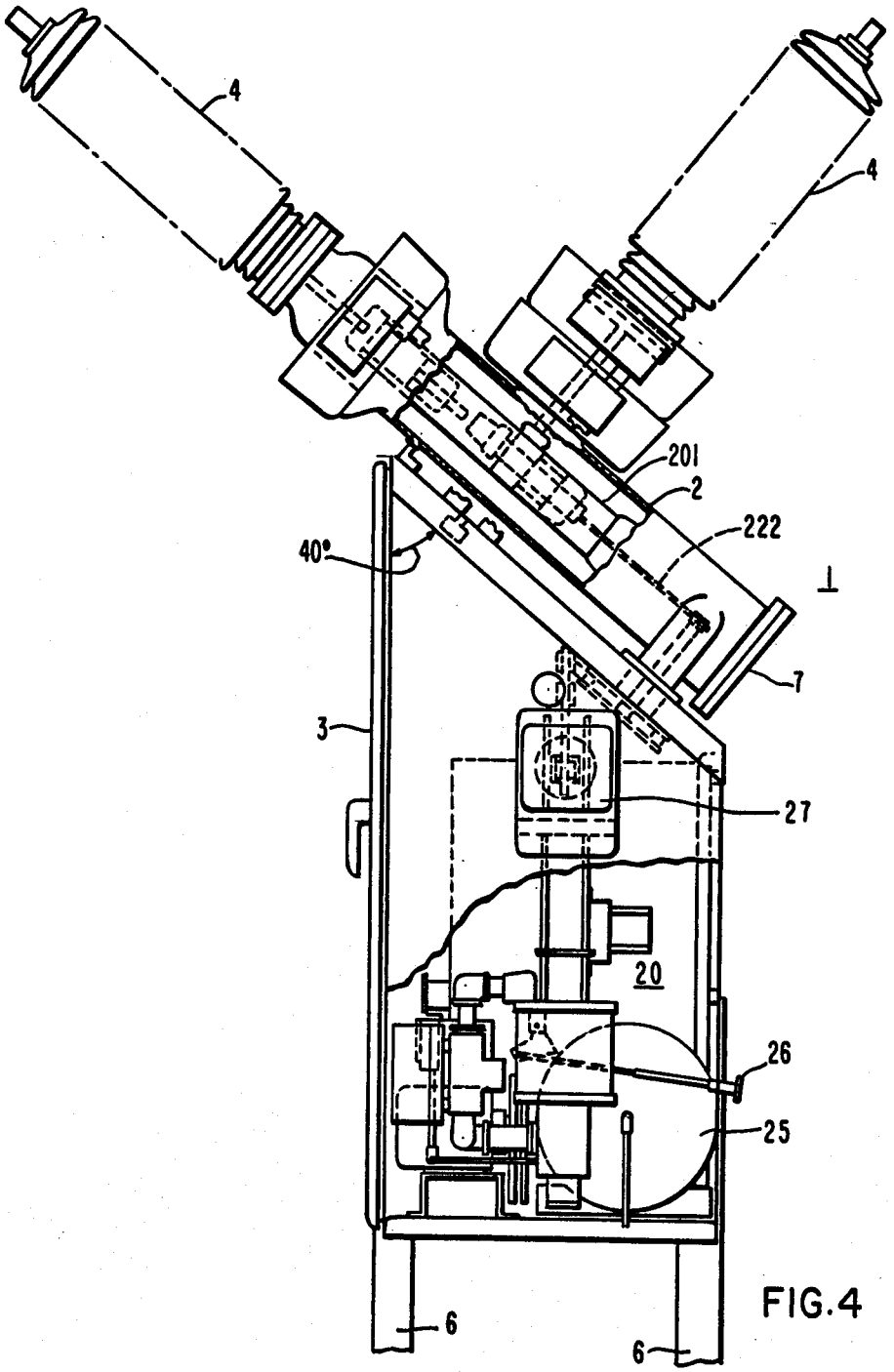
FIG. 4 is similar to FIG. 2 but with parts broken away.

There is shown in FIGS. 1, 2 and 4 a circuit interrupter 1 generally comprised of a control housing 3, an interrupter assembly 2, and a drive mechanism 20. The control housing 3 is supported on four legs 6. These legs are removable for shipping and easily support the 3000 lb. weight of the circuit interrupter 1 when bolted down. The roof of the control housing 3 is sloped at an angle of 40 degrees. Mounted upon the control housing roof are three interrupter assemblies 2 for each phase of a three phase system. Connected to the assemblies 2 are terminal bushings 4 for terminating the incoming power lines. The 40 degree slope in the control housing roof is designed to allow the arc products and particles to migrate due to gravity to the ground end of the interrupter assembly 2 away from the high voltage field. An inspection plate 7 allows the assembly to be easily cleared and maintained.

Figure 5A:
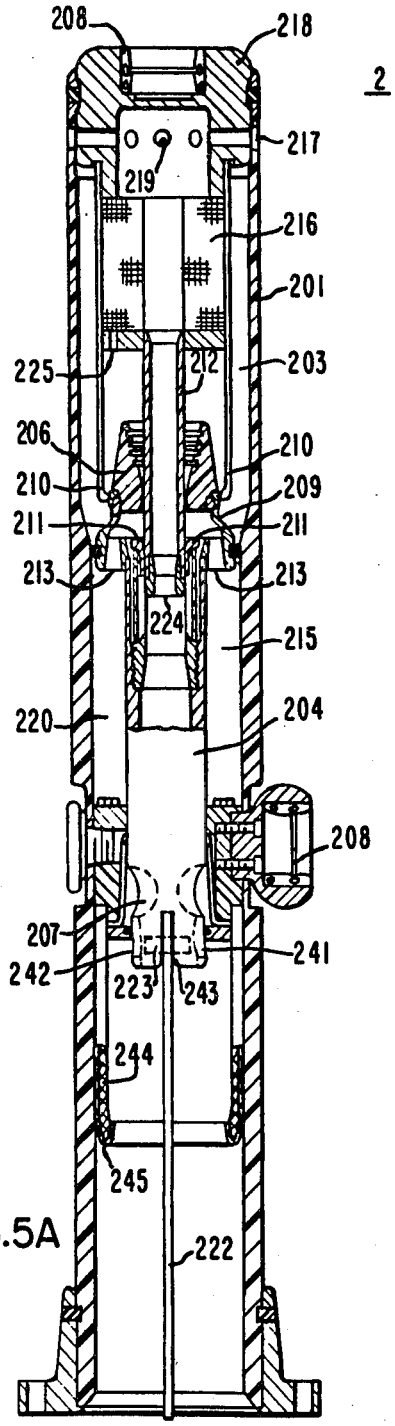
FIGS. 5A and 5B are elevational sectional views of the interrupter assembly.
Figure 5B:
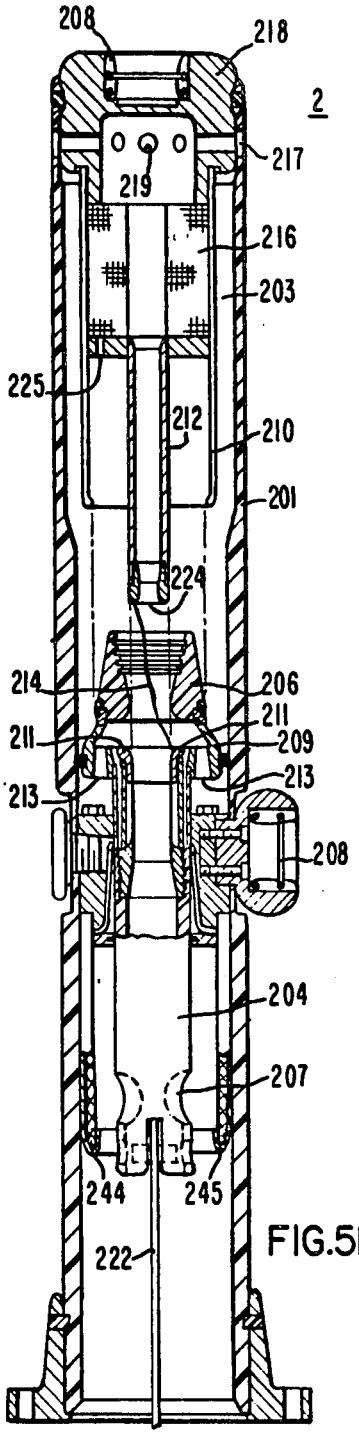

The interrupter assembly 2 is shown in greater detail in FIGS. 5A and 5B. The interrupter assembly 2 is generally comprised of an insulating housing 201 having a narrowing inner diameter, with a relatively stationary contact assembly 203 and a relatively movable contact assembly 204 contained within the housing 201. The housing 201 is generally comprised of a filament wound glass epoxy material. Two sets of transfer contacts 208 are provided to make a plug-in connection with the bushing conductors for the incoming and out-going power lines.

The stationary contact assembly 203 is generally comprised of a stationary contact base 218 with fourteen equally spaced stationary contact fingers 210 mounted to the contact base. A copper venting screen 216 is mounted between the contact base 218 and a stationary arcing contact 212. The arcing contact 212 has a center opening 224 and fourteen vent openings 225 in its base. During interruption, hot gasses are exhausted upstream through the center opening 224 and vent openings 225 to the copper venting screen 216. These vent openings 224, 225, along with the venting screen 216 cooperate with vent openings 217 and 219 in the contact base 218 for upstream exhaust outside the insulating housing.

The movable contact assembly 204 is generally comprised of a movable hollow tube structure upon which is connected a piston structure 209. The piston structure 209 includes arcing contacts 211 that make contact with the stationary arcing contacts 212. Arc blast openings 213 are blocked when the two arcing contacts 211 and 212 are making contact and open when these arcing contacts part during interruptions. Mounted upon the piston structure 209 is an orifice 206 that directs the arc blasts from openings 213 into the arc established between the arcing contacts 211 and 212 during opening operations. The lower portion of the movable contact assembly 204 includes vent openings 207 in the hollow tube structure and openings 241, 242 and 243 for connecting an operating rod 222 by means of a pin 223.

During the opening operation, the operating rod 222 is operable to move the movable contact assembly 204 in a downward direction. On opening, the piston structure 209 separates from the stationary contact fingers 210 compresses the gas 220 within the region 215. Initially thereafter contact is only maintained between the stationary arcing contact 212 and the movable arcing contact 211. Upon separation of the arcing contacts 211 and 212 arc blast openings 213 are unblocked and the gas 220 is forced through the arc blast openings 213 upwardly through the orifice 206 into the arc 214 established between the arcing contacts 211 and 212 illustrated in FIG. 2. Hot gases and arcing products are swept upstream away from the interrupting region through the center opening 224 and the vent openings 225 of the stationary arcing contact 212. Hot gases are also vented downstream through the center of the movable hollow tube structure 240 and out vent openings 207. These gases are cooled by means of a copper venting screen 244 contained within a copper shielding 245.

Figure 3:
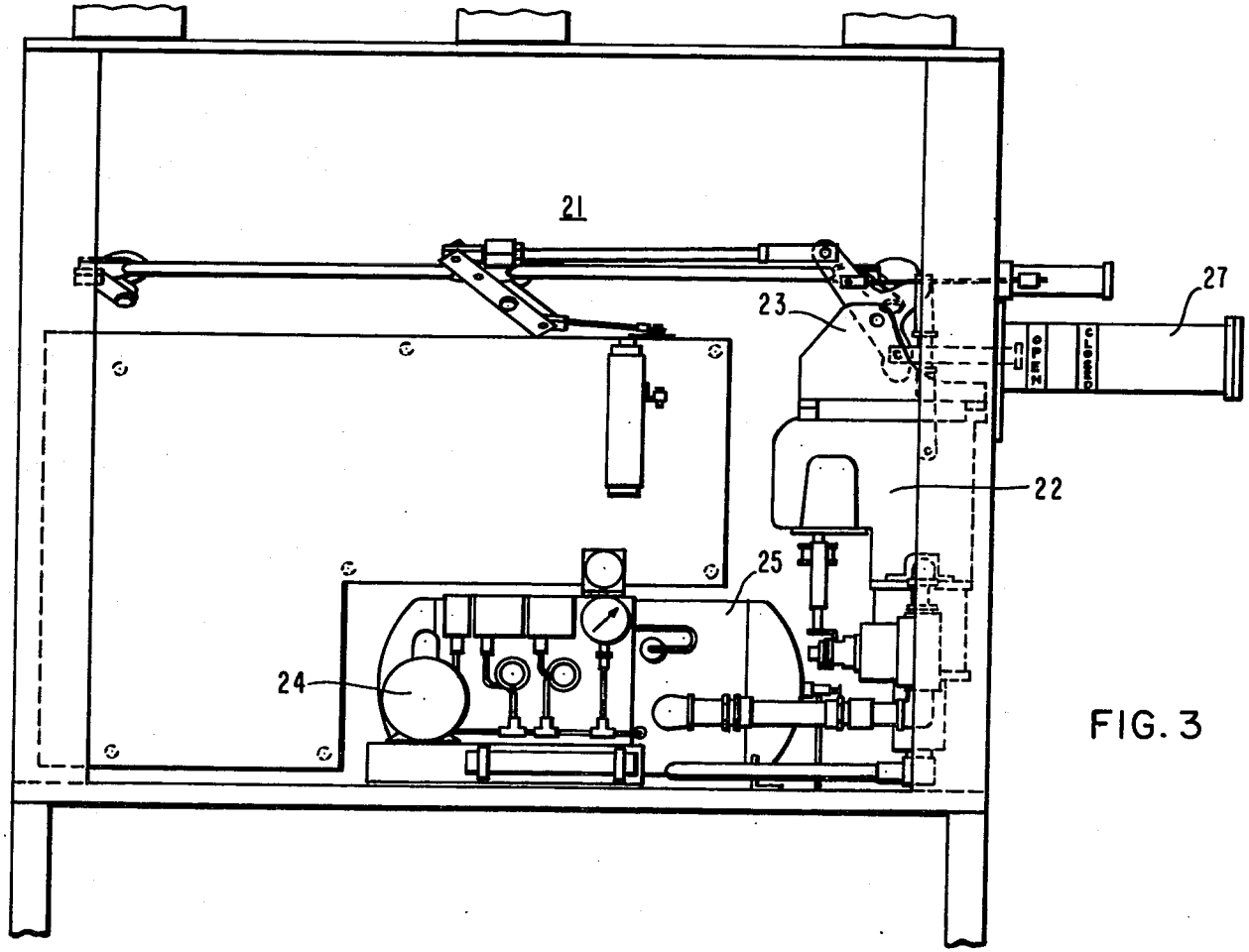
FIG. 3 is similar to FIG. 1 but with parts broken away.

As can be seen in FIGS. 3 and 4, the operating rod 222 is connected to the drive mechanism 20 by means of linkage 21. The drive mechanism 20 is generally comprised of a trip mechanism 22, a bell crank 23, compressor motor 24 storage reservoir 25, and hand trip lever 26. Also included in the control cabinet are the necessary auxiliary switches, cut-off switch, latch check switch, alarm switch, control relays, and operation counter not shown but well known in the art. The trip mechanism 22 is the type disclosed in U.S. Pat. No.

3,450,955, issued June 17, 1969 to F. D. Johnson. Energy for opening the circuit interrupter is stored in the tail spring 27 located on the control housing 3, permitting the breaker to be tripped with a low energy signal. When tripped, the spring transmits its energy to linkage assembly 21 which transfers the motion to the operating rod 222 and the movable contact 204. To close the breaker, a low energy signal actuates an arc valve not shown on the trip mechanism 22. High pressure air stored in the reservoir 25 operates against a piston not shown in the trip mechanism 22. The closing force is transmitted through the linkage assembly 21 to the tail spring 27 and the movable contact 204.

From the foregoing, it can be readily seen that there is provided by this invention an improved circuit breaker utilizing a novel configuration that improves efficiency and reliability.

Although there has been illustrated and described specific structures, it is to be clearly understood that the same were merely for purposes of illustration and that changes and modifications may readily be made therein by those skilled in the art without departing from the spirit and scope of the invention.

I claim:

1. Circuit interrupter, comprising:

(a) a assembly with an insulating housing containing a compressed insulating gas and separable electrical contacts;

(b) a control means operable to open and close said separable electrical contacts including electrical and mechanical actuating means for operating said separable electrical contact; and (c) a control housing for suppprting said control means and said interrupter assembly such that the interrupter assembly has connected to it a rectilinear bushing means in a parallel relationship with the top of the control housing and a perpendicular bushing means in a perpendicular relationship with the top of the control housing.

2. Circuit interrupter, as recited in claim 1 wherein the control housing for supporting the control means and supporting the interrupter assembly is disposed to support the interrupter assembly at an oblique angle.

3. A circuit interrupter, comprising:

(a) an interrupter assembly including a pair of separable contacts operable between opened and closed operating positions being disposed generally within an insulating housing having a narrowing inner diameter;

(b) a piston structure disposed generally within said insulating housing movable with respect to each other to compress a gas within the narrowed inner diameter of said insulating housing;

(c) control means for moving the separable contacts between the opened and closed operating positions;

(d) flow means for directing a gas which is compressed between said insulating housing and piston structure into engagement with an arc drawn between said separable contacts to effect extinction of said arc during an opening operation;

(e) a venting screen disposed to vent hot gases and arcing products away from the separated contacts;

(f) vent openings in the base of the stationary contact to exhaust hot gases and arcing products outside the insulating housing; and (g) a control housing for supporting said control means and said interrupter assembly such that the interrupter assembly has connected to it a rectilinear bushing means in a parallel relationship with the top of the control housing and a perpendicular bushing means in a perpendicular relationship with the top of the control housing.

4. A circuit interrupter, as recited in claim 3 wherein the control housing for supporting the control means and for supporting the interrupter assembly is disposed to support the interrupter assembly at an oblique angle.

5. A circuit interrupter, comprising:

(a) an interrupter assembly with a housing containing separable electrical contacts;

(b) a control means including electrical and mechanical actuating means for operating the separable electrical contacts between opened and closed positions;

(c) a rectilinear bushing connected to the interrupter assembly at one end in cooperation with a perpendicular bushing connected to the interrupter assembly at the side thereof; and (d) support means for supporting the interrupter assembly at an oblique angle with reference to ground.

6. A circuit interrupter, comprising:

(a) an interrupter assembly including a pair of separable contacts operable between opened and closed positions disposed generally within an insulating housing having a narrowing inner diameter;

(b) a piston structure disposed generally within the insulating housing movable with respect to each other to compress a gas within the narrowed inner diameter of the insulating housing;

(c) a control means including mechanical and electrical actuating means for operating the separable electrical contacts between the opened and closed positions;

(d) a flow means for directing the gas which is compressed between the insulating housing and the piston structure into engagement with an arc drawn between the separable contacts to effect extinction of the arc during an opening operation;

(e) a venting screen disposed to vent hot gases and arcing products away from the separating contacts;

(f) vented openings in the base of the stationary contact to exhaust hot gases and arcing products outside the insulating housing; and (g) a rectilinear bushing connected to the interrupter assembly at one end in cooperation with a perpendicular bushing connected to the interrupter assembly at the side thereof; and (h) a support means for supporting the interrupter assembly at an oblique angle with reference to ground.

* * * * *

UNITED STATES PATENT AND TRADEMARK OFFICE

CERTIFICATE OF CORRECTION

PATENT NO. : 4,434,334

DATED : February 28, 1984

INVENTOR(S) : Charles W. Tragesser

It is certified that error appears in the above—identified patent and that said Letters Patent is hereby corrected as shown below:

On the title page, under the heading REFERENCES CITED U.S. PATENT DOCUMENTS, insert the following references:

| | | | | |
|---|---|---|---|---|
| -- 3,114,815 | 12/1963 | Easley et al | 200/148A | |
| 3,158,723 | 11/1964 | Buechner | 200/148A | |
| 3,739,125 | 6/1973 | Noeske | 200/148A | |
| 3,829,642 | 8/1974 | Graybill | 200/148R | |
| 3,944,886 | 3/1976 | Ishida et al. | 200/148G | |
| 4,109,124 | 8/1978 | Boersma et al. | 200/148R | --. |

On the title page, under the heading REFERENCES CITED FOREIGN PATENT DOCUMENTS, insert the following references:

| | | | | |
|---|---|---|---|---|
| -- 928,916 | 6/1963 | Great Britain | 200/148R | |
| 575,023 | 3/1958 | Italy | 200/148R | --. |

In column 3, on line 26, cancel "a", second occurrence and substitute -- an interrupter --; same line, cancel "an insulating" and substitute -- a --; same line, cancel "a" last occurrence; in column 3, on line 27, cancel "compressed insulating gas and".

Signed and Sealed this

*Fourteenth* Day of *May 1985*

[SEAL]

*Attest:*

DONALD J. QUIGG

*Attesting Officer* *Acting Commissioner of Patents and Trademarks*